US009630791B2

(12) United States Patent
Shiokawa et al.

(10) Patent No.: US 9,630,791 B2
(45) Date of Patent: Apr. 25, 2017

(54) IMAGE-FORMING APPARATUS THAT FORMS IMAGE ON LONG SHEET

(71) Applicant: Konica Minolta, Inc., Tokyo (JP)

(72) Inventors: Yasuo Shiokawa, Tokyo (JP); Akihiko Kakita, Tokyo (JP); Takahiro Okubo, Kanagawa-ken (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/964,064

(22) Filed: Dec. 9, 2015

(65) Prior Publication Data

US 2016/0159594 A1 Jun. 9, 2016

(30) Foreign Application Priority Data

Dec. 9, 2014 (JP) ..... 2014-248984

(51) Int. Cl.

| | |
|---|---|
| ***B65H 5/06*** | (2006.01) |
| ***G03G 15/00*** | (2006.01) |
| ***B65H 7/02*** | (2006.01) |
| ***B65H 1/04*** | (2006.01) |

(52) U.S. Cl.

CPC ..... *B65H 5/062* (2013.01); *B65H 1/04* (2013.01); *B65H 7/02* (2013.01); *G03G 15/6514* (2013.01); *B65H 2405/324* (2013.01); *B65H 2407/21* (2013.01); *B65H 2511/11* (2013.01); *B65H 2513/10* (2013.01); *B65H 2513/108* (2013.01); *B65H 2701/11312* (2013.01); *G03G 15/50* (2013.01); *G03G 15/6594* (2013.01); *G03G 2215/00949* (2013.01)

(58) Field of Classification Search

CPC ..... B41J 13/0018; B41J 13/0054; B65H 5/34; B65H 2513/10; B65H 7/02; G03G 15/6514

USPC ..... 271/270

See application file for complete search history.

(56) References Cited

U.S. PATENT DOCUMENTS

| | | | | |
|---|---|---|---|---|
| 5,924,686 | A * | 7/1999 | Jacobson | B65H 7/00 271/10.03 |
| 2004/0227283 | A1* | 11/2004 | Hanada | B65H 5/06 271/270 |
| 2004/0251589 | A1* | 12/2004 | Satoh | B65H 5/062 271/10.01 |

(Continued)

FOREIGN PATENT DOCUMENTS

JP H05-246094 A 9/1993

*Primary Examiner* — Patrick Cicchino
(74) *Attorney, Agent, or Firm* — Osha Liang LLP

(57) ABSTRACT

An image-forming apparatus contains an external feeding tray on which a sheet is put, and a feeding roller and a sheet feeder that feed the sheet from the external feeding tray. A controller of the image-forming apparatus sets a first conveying speed and a second conveying speed that is slower than the first conveying speed, controls the sheet feeder to convey a second sheet, which has a longer length along a conveying direction thereof than the length of the external feeding tray, at the second conveying speed when the controller determines that a rear end of the second sheet projects from the external feeding tray, and hangs down from the external feeding tray based on the sheet information and controls a first sheet, which has a shorter length along a conveying direction thereof than the length of the external feeding tray, at the first conveying speed.

10 Claims, 12 Drawing Sheets

(56) References Cited

U.S. PATENT DOCUMENTS

| | | | | |
|---|---|---|---|---|
| 2006/0237902 | A1* | 10/2006 | Yoshizawa | B65H 5/34 271/258.01 |
| 2009/0033030 | A1* | 2/2009 | Yasumoto | B65H 7/06 271/278 |
| 2009/0236385 | A1* | 9/2009 | Itoh | B65H 20/32 226/10 |
| 2009/0267294 | A1* | 10/2009 | Hojo | B65H 5/34 271/265.01 |
| 2010/0014884 | A1* | 1/2010 | Roppongi | B41J 3/60 399/82 |
| 2010/0239296 | A1* | 9/2010 | Kimura | G03G 15/234 399/68 |
| 2012/0002227 | A1* | 1/2012 | Ogino | B41J 11/009 358/1.12 |

* cited by examiner

Related Art

Related Art

IMAGE-FORMING APPARATUS THAT FORMS IMAGE ON LONG SHEET

CROSS REFERENCES TO RELATED APPLICATION

The present invention contains subject matter related to Japanese Patent Application JP 2014-248984 filed in the Japanese Patent Office on Dec. 9, 2014, the entire contents of which being incorporated herein by reference.

BACKGROUND OF THE INVENTION

Technical Field

The present invention relates to an image-forming apparatus that forms an image on a long sheet.

Background Art

In the past, an electro photographic image-forming apparatus such as a printer, a copier and the like has been known. In such an image-forming apparatus, an image has been formed with sheets contained in a feeding tray being conveyed one by one.

A size of the sheet containable in a feeding tray installed inside the image-forming apparatus, particularly, a length of the sheet along a conveying direction of the sheet is fixed by a size of the image-forming apparatus. On the other hand, in a feeding tray, called as "manual feed tray", which is installed outside the image-forming apparatus, any long sheet can be put thereon regardless of the size of the image-forming apparatus. Accordingly, an image-forming apparatus by which a long sheet being longer than a length of the feeding tray along the conveying direction thereof may be put on the feeding tray and an image can be formed on the long sheet has been proposed.

Here, in a sheet-feeding operation from the manual feed tray, a technology of changing any conveying speeds of the sheet in order to increase a number of the conveying sheets per unit time has also been proposed (see Japanese Patent Application Publication No. H05-246094).

FIGS. 1A through 1C show conditions in each of which a sheet is put on the external feeding tray. FIG. 2 shows a condition in which the sheet is put on the external feeding tray and is conveyed from the external feeding tray. When a length L of a sheet P is shorter than a length L10 of an external feeding tray 20, a rear end of the sheet P does not hang down from a rear end position P1 of the external feeding tray 20, as shown in FIG. 1A. In this condition, it is possible to securely convey the sheet.

When a sheet P has high stiffness even in a case where a length L of a sheet P is longer than a length L10 of an external feeding tray 20, a rear end of the sheet P does not hang down from a rear end position P1 of the external feeding tray 20, as shown in FIG. 1B. In this condition, it is also possible to securely convey the sheet.

On the other hand, when a sheet P has low stiffness and a length L of a sheet P is longer than a length L10 of an external feeding tray 20, a rear end of the sheet P hangs down from a rear end position P1 of the external feeding tray 20, as shown in FIG. 1C. When the rear end of the sheet P hangs down from the rear end position P1 of the external feeding tray 20, any resistance force shown by an arrow R in FIG. 2 is applied to a part B1 of the sheet P put on the external feeding tray 20 against any conveying force F shown by an arrow F in FIG. 2. Thus, the part B1 of the sheet P is pulled in parallel with the conveying direction of the sheet P.

In, however, a part B2 of the sheet P hanged down from the rear end position P1 of the external feeding tray 20, the conveying force F is not applied in parallel with the conveying direction of the sheet P so that the sheet P may be caught by the rear end position P1 of the external feeding tray 20. When the sheet P may be caught by the rear end position P1 of the external feeding tray 20, the rear end of the sheet P may raise as shown by the dotted line in FIG. 2 by any counterforce.

This raise of the rear end of the sheet P may cause the part B1 of the sheet P put on the external feeding tray 20 to raise from the external feeding tray 20. On the external feeding tray 20, guide plates 200 are provided along a width direction of the sheet P to correct any deflection of the sheet P. When the part 31 of the sheet P put on the external feeding tray 20 raises from the external feeding tray 20 as shown by a long dashed short dashed line in FIG. 2, the sheet P may contact the guide plates 200 correctly so that the sheet P may be deflected. Such a deflection may cause any poor functioning such as defective image, crumpled sheet and the like to occur. This may deteriorate any printing quality. In the past, any image-forming apparatus to address such poor functioning which may occur when feeding the long sheet has not been proposed.

SUMMARY

One or more embodiments of the present invention provide an image-forming apparatus that prevents the sheet from raising when feeding any long sheet which is longer than the feeding tray.

An image-forming apparatus according to one or more embodiments of the present invention contains an external feeding tray that has a length along a conveying direction of a first sheet or a second sheet, the first sheet or the second sheet being put thereon. The first sheet has a shorter length along a conveying direction thereof than the length of the external feeding tray, and the second sheet has a longer length along a conveying direction thereof than the length of the external feeding tray. The image forming apparatus further contains a sheet feeder that feeds the first sheet or the second sheet from the external feeding tray to an image former, an image former that forms an image on the first sheet or the second sheet fed by the sheet feeder, a sheet information acquirer that acquires sheet information comprising a sheet size that specifies the length of the first sheet or the second sheet, and a controller. The controller sets a first conveying speed and a second conveying speed, the second conveying speed being slower than the first conveying speed, controls the sheet feeder to convey the first sheet at the first conveying speed, and controls the sheet feeder to convey the second sheet at the second conveying speed when the controller determines that a rear end of the second sheet projects from the external feeding tray and hangs down from the external feeding tray based on the sheet information.

According to one or more embodiments of the present invention, the controller may set a third conveying speed that is faster than the second conveying speed, and may control the sheet feeder to change the conveying speed of the second sheet from the second conveying speed to the third conveying speed when the controller determines that the rear end of the second sheet fed from the external feeding tray at the second conveying speed passes through a rear end position of the external feeding tray and the second sheet reaches a conveying speed change position based on the sheet information.

According to one or more embodiments of the present invention, the controller may set an image forming conveying speed to form the image on the second sheet by the image former, and may control the sheet feeder to change the conveying speed of the second sheet from the second conveying speed to the first conveying speed or the image forming conveying speed when the controller determines that the rear end of the second sheet fed from the external feeding tray at the second conveying speed passes through a rear end position of the external feeding tray and the second sheet reaches the conveying speed change position according to a reached position of a forward end of the second sheet. The reached position differs from the length of the second sheet.

According to one or more embodiments of the present invention, the controller may control the sheet feeder to convey the second sheet at the second conveying speed when the controller determines that the rear end of the second sheet fed from the external feeding tray at the second conveying speed does not pass through the rear end position of the external feeding tray and a forward end of the second sheet reaches the conveying speed change position based on the sheet information.

According to one or more embodiments of the present invention, in the image-forming apparatus, the controller may determine whether or not the conveying speed of the second sheet fed from the external feeding tray at the second conveying speed is changed and may set the conveying speed of the second sheet that is again conveyed when the forward end of the second sheet reaches a temporal stop position.

According to one or more embodiments of the present invention, the image-forming apparatus may further contain a sheet detector that detects the first sheet or the second sheet, wherein the controller determines a rear end position of the first sheet or the second sheet based on the sheet information when the sheet detector detects a forward end of the first sheet or the second sheet.

According to one or more embodiments of the present invention, the controller may accelerate the conveying speed of the second sheet until the second sheet reaches the conveying speed change position when the feeding of the second sheet put on the external feeding tray is started at the second conveying speed.

According to one or more embodiments of the present invention, the third conveying speed may be faster than the first conveying speed.

According to one or more embodiments of the present invention, the sheet information acquirer may include a manipulator that selects at least one of the sheet size, paper weight of the first sheet or the second sheet, a type of the first sheet or the second sheet, and a use environment of the image-forming apparatus.

According to one or more embodiments of the present invention, the external feeding tray may have a bent surface on which the first sheet or the second sheet is placed.

Other aspects of one or more embodiments of the present invention will be become apparent to those skilled in the art upon a reading of the following detailed description when taken in conjunction with the drawing.

DETAILED DESCRIPTION OF EMBODIMENTS

The following will describe embodiments of an image-forming apparatus according to one or more embodiments of the present invention with reference to the drawings. Such description does not limit the technical scope, meaning of terms and the like in Claims.

<Configuration Example of Image-Forming Apparatus according to one or more Embodiments of Present Invention>

Figure 1A:
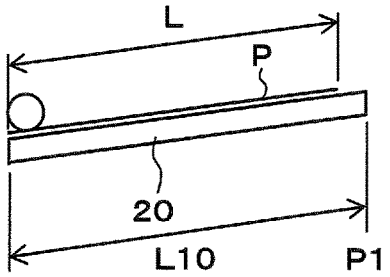
FIG. 1A is a diagram showing a condition in which a sheet is put on an external feeding tray according to related art.
Figure 1B:
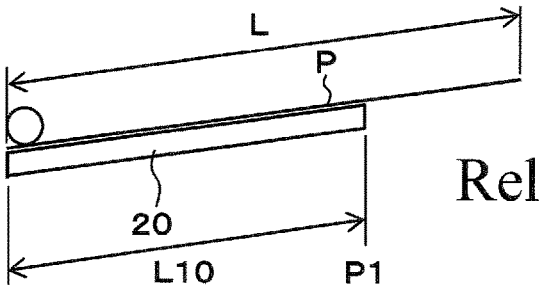
Related Art FIG. 1B
FIG. 1B is a diagram showing a condition in which a sheet is put on an external feeding tray according to related art.
Figure 1C:
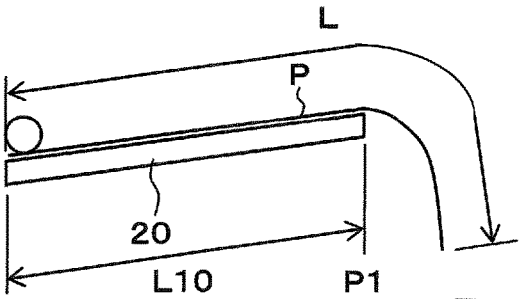
Related Art FIG. 1C
FIG. 1C is a diagram showing a condition in which a sheet is put on the external feeding tray according to related art.
Figure 2:
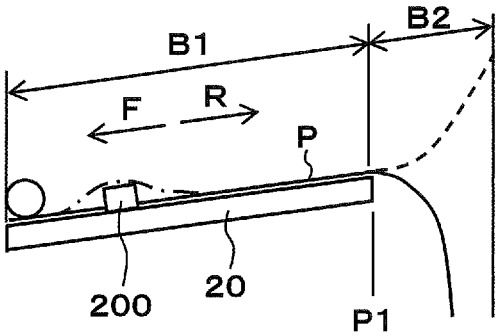
FIG. 2 is a diagram showing a condition in which the sheet is put on an external feeding tray and is conveyed from the external feeding tray according to related art.
Figure 3:
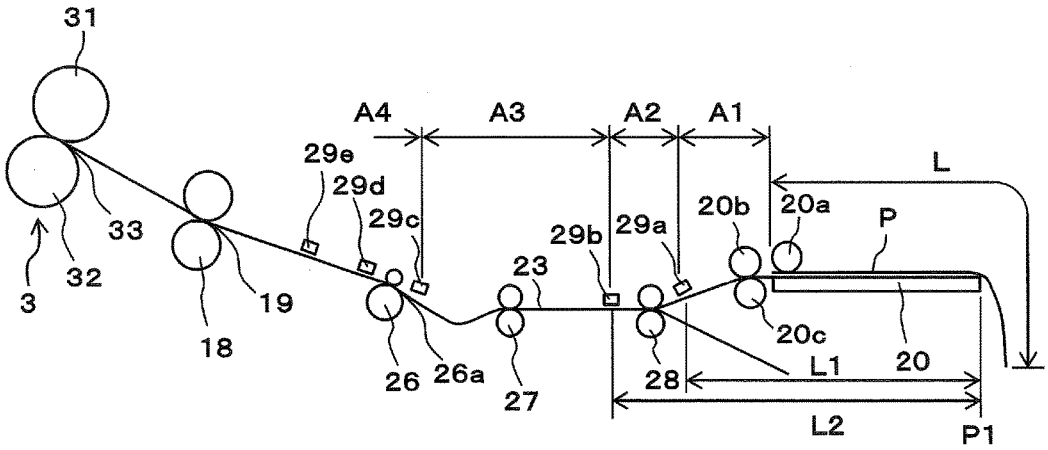
FIG. 3 is a diagram showing a configuration of a part of an image-forming apparatus according to one or more embodiments of the present invention.
Figure 4A:
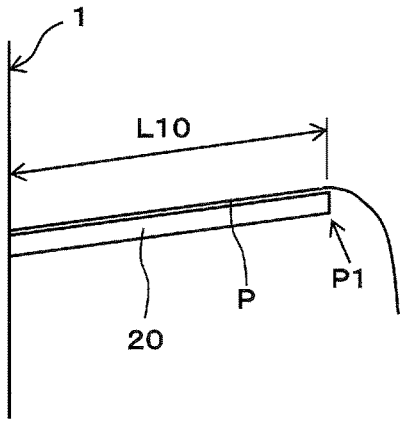
FIG. 4A is a diagram showing a configuration of a part of a feeding tray in an image-forming apparatus according to one or more embodiments of the present invention.
Figure 4B:
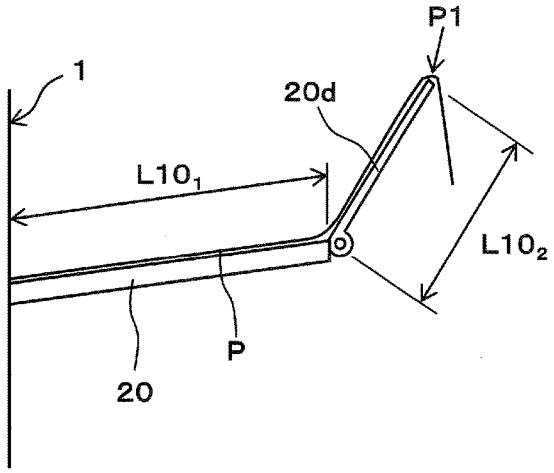
FIG. 4B is a diagram showing a configuration of a part of a feeding tray in an image-forming apparatus according to one or more embodiments of the present invention.
Figure 5:
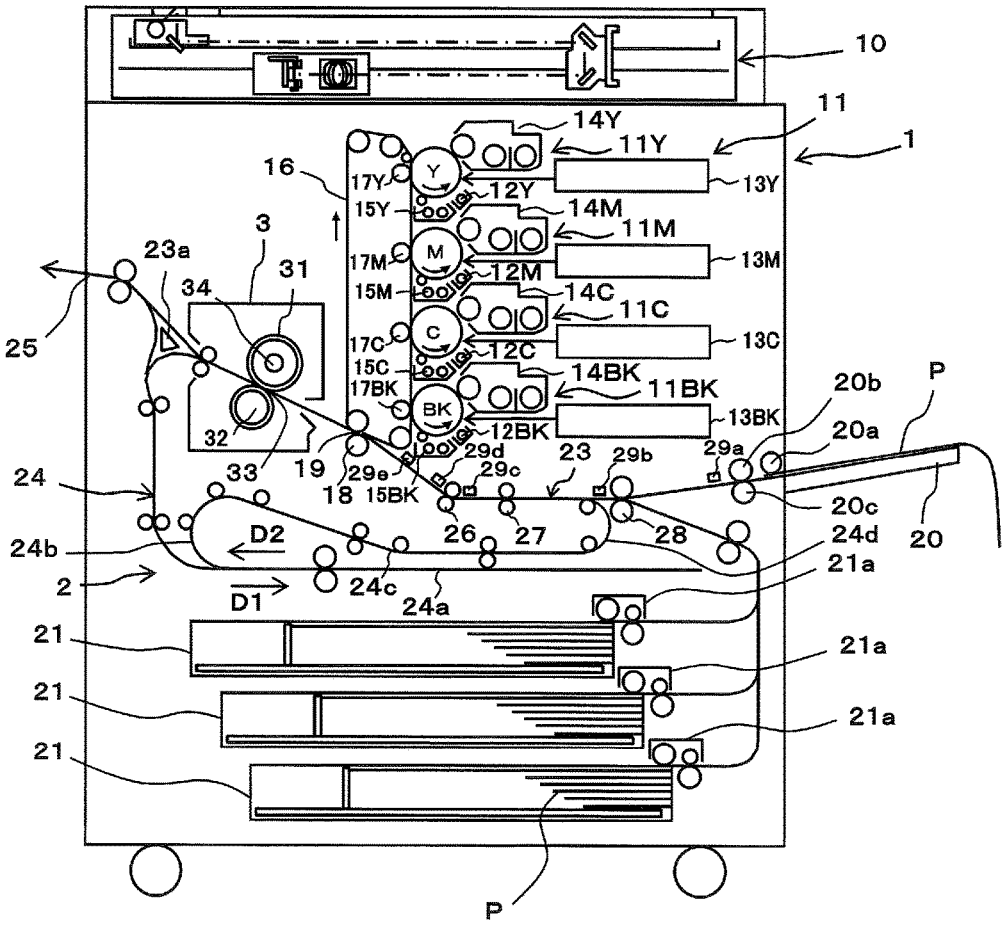
FIG. 5 is a schematic illustration of an image-forming apparatus according to one or more embodiments of the present invention.

FIG. 3 shows a configuration of a part of the image-forming apparatus according to one or more embodiments of the present invention and shows a conveying route of a sheet in the image-forming apparatus 1. FIGS. 4A and 4B are diagrams each showing a configuration of a part of a feeding tray in the image-forming apparatus according to one or more embodiments of the present invention and showing a configuration of the feeding tray of the image-forming apparatus 1. FIG. 5 schematically shows the image-forming apparatus 1 according to one or more embodiments of the present invention.

The image-forming apparatus 1 is an electro photographic image-forming apparatus such as a copier. The image-forming apparatus 1 is a so-called color image-forming apparatus of a tandem type, in which plural photoreceptors are arranged vertically so as to be opposed to one intermediate transfer belt to form a full color image thereon.

The image-forming apparatus 1 is provided with a document-reading device 10, an image-forming portion 11 (may be referred to as "an image former"), a sheet-conveying portion 2, and a fixing portion 3.

The document-reading device 10 scans and exposes an image on the document using an optical system of a scanning and exposing device. The document-reading device 10 reads reflected right by its line image sensor to obtain an image signal. It is to be noted that in the image-forming apparatus 1, an automatic document feeder, not shown, for automatically feeding the documents may be mounted on an upper portion thereof.

The image-forming portion 11 includes an image-forming unit 11Y which forms a yellow (Y) image, an image-forming unit 11M which forms a magenta (M) image, an image-forming unit 11C which forms a cyan (C) image and an image-forming unit 11K which forms a black (BK) image.

The image-forming unit 11Y contains a photosensitive drum Y, a charging portion 12Y positioned around the photosensitive drum Y, an optical writing portion 13Y, a developing portion 14Y and a drum cleaner 15Y. Similarly, the image-forming unit 11M contains a photosensitive drum M, a charging portion 12M positioned around the photosensitive drum M, an optical writing portion 13M, a developing portion 14M and a drum cleaner 15M. The image-forming unit 11C contains a photosensitive drum C, a charging portion 12C positioned around the photosensitive drum C, an optical writing portion 13C, a developing portion 14C and a drum cleaner 15C. The image-forming unit 11K contains a photosensitive drum BK, a charging portion 12BK positioned around the photosensitive drum BK, an optical writing portion 13BK, a developing portion 14BK and a drum cleaner 15BK.

The charging portion 12Y charges a static charge uniformly around the surface of the photosensitive drum Y. The exposing portion 13Y scans and exposes a surface of the photosensitive drum Y to form an electrostatic latent image on the photosensitive drum Y. The developing portion 14Y develops the electrostatic latent image formed on the surface of the photosensitive drum Y by using toner. Accordingly, a visible toner image corresponding to yellow is formed on the photosensitive drum Y.

Similarly, the charging portion 12M charges a static charge uniformly around the surface of the photosensitive drum M. The exposing portion 13M scans and exposes a surface of the photosensitive drum M to form an electrostatic latent image on the photosensitive drum M. The developing portion 14M develops the electrostatic latent image formed on the surface of the photosensitive drum M by using toner. Accordingly, a visible toner image corresponding to the magenta is formed on the photosensitive drum M.

The charging portion 12C charges a static charge uniformly around the surface of the photosensitive drum C. The exposing portion 13C scans and exposes a surface of the photosensitive drum C to form an electrostatic latent image on the photosensitive drum C. The developing portion 14C develops the electrostatic latent image formed on the surface of the photosensitive drum C by using toner. Accordingly, a visible toner image corresponding to cyan is formed on the photosensitive drum C.

The charging portion 12BK charges a static charge uniformly around the surface of the photosensitive drum BK. The exposing portion 13BK scans and exposes a surface of the photosensitive drum BK to form an electrostatic latent image on the photosensitive drum BK. The developing portion 14BK develops the electrostatic latent image formed on the surface of the photosensitive drum BKC by using toner. Accordingly, a visible toner image corresponding to black is formed on the photosensitive drum BK.

Primary transfer rollers 17Y, 17M, 17C and 17BK transfer the images formed on the photosensitive drums Y, M, C and BK one by one onto predetermined positions of an intermediate transfer belt 16 which is a belt-like intermediate transfer member.

Secondary transfer rollers 18 transfer each color image transferred onto the intermediate transfer belt 16 to the sheet P, which is conveyed by the sheet-conveying portion 2, at a predetermined timing. The secondary transfer rollers 18 are arranged so that they contact the intermediate transfer belt 16 with any pressure. Under this condition, they form a transfer nip portion 19 and transfer the images on the sheet P with them conveying the sheet P.

The sheet-conveying portion 2 includes feeding trays, in one or more embodiments, plural feeding trays 21, containing the sheets P and an external feeding tray 20 on which a sheet P is put. The sheet-conveying portion 2 also includes a main sheet-conveying route 23 on which the sheet P fed from the external feeding tray 20 or the sheet P fed from any of the feeding trays 21 is conveyed, and a reverse sheet-conveying route 24 in which the sheet P is reversed.

The sheet-conveying route from the external feeding tray 20 to a sheet-ejecting port 25 constitutes the main sheet-conveying route 23. The sheet-conveying route from the feeding tray 21 comes together the main sheet-conveying route 23 at an upstream side of a confluent portion of the main sheet-conveying route 23 and the reverse sheet-conveying route 24.

The external feeding tray 20 is called as the manual feed tray and is an example of the feeding tray of one or more embodiments of the present invention. The external feeding tray 20 projects out of the image-forming apparatus 1 and a shown in FIG. 4A, the external feeding tray 20 has a flat surface on which the sheet P is put. Alternatively, the external feeding tray 20 projects out of the image-forming apparatus 1 so that its projection amount is limited. This external feeding tray 20 has a bent surface on which the sheet P is put, as shown in FIG. 4B, so that a second sheet (hereinafter, referred to as "long sheet P") having a longer length along a conveying direction of the sheet than a length of the external feeding tray 20 can be put thereon.

When the length of the sheet P along a conveying direction of the sheet P is set to be L, in a configuration shown in FIG. 4A, the length L10 of the external feeding tray 20 is shorter than L. The rear end of the sheet P thus hangs down from the rear end P1 of the external feeding tray 20. Further, in a configuration shown in FIG. 4B, the length $L10_1+L10_2$ of the external feeding tray 20 is shorter than L. The rear end of the sheet P thus hangs down from the rear end P1 of the external feeding tray 20.

As a feeding portion (may be referred to as "a sheet feeder"), the sheet-conveying portion 2 is provided with a feeding roller 20*a* that feeds the sheet put on the external feeding tray 20. The sheet-conveying portion 2 is also provided with a conveying roller 20*b* that conveys the sheet fed by the feeding roller 20*a* at a downstream side of the feeding roller 20*a* along the conveying direction of the sheet P. The sheet-conveying portion 2 is further provided with a separation roller 20*c* which, when the feeding roller 20*a* feeds more than one sheet, separates a top sheet from other sheets that contact the conveying roller 20*b*, so as to be opposed to the conveying roller 20*b*. Additionally, the sheet-conveying portion 2 is provided with feeders 21*a* installed inside the image-forming apparatus 1, each of which feeds the sheets P contained in each of the feeding trays 21.

The sheet-conveying portion 2 is still further provided with register rollers 26 by which an inclination of the sheet P, so-called a skew, and a deviation in the position of the sheet P along the width direction thereof which is perpendicular to the conveying direction of the sheet are corrected. The sheet-conveying portion 2 is still additionally provided with loop rollers 27 that hit a forward end of the sheet P to the register rollers 26.

The register rollers 26 are configured to be a pair of rollers that are opposed to each other with them nipping the sheet P conveyed on a main sheet-conveying route 23. Each roller of the register rollers 26 is provided with a shaft extending to a direction that is perpendicular to the conveying direction of the sheet P. The register rollers 26 are rotated in the reverse directions to each other to convey the sheet P along the conveying direction of the sheet P.

The skew of the sheet P is corrected on a direction along a surface of the sheet P by hitting the forward end of the sheet P to a nip portion constituted by the pair of register rollers 26 while the register rollers 26 stop. By rotating the register rollers 26 in the reverse directions to each other, the sheet P is conveyed with them nipping the sheet P. The deviation of the sheet P along the width direction thereof is corrected by moving the register rollers 26 to the width direction of the sheet P which is perpendicular to the conveying direction of the sheet P, with the pair of the register rollers nipping the sheet P. As described above, a series of sheet-position correction operations for correcting the deviation of sheet P along the width direction thereof is referred as "register fluctuation".

The loop rollers 27 are configured to be a pair of rollers that are opposed to each other with them nipping the sheet P conveyed on the main sheet-conveying route 23 and are provided at an upstream side of the register rollers 26 along the conveying direction of the sheet P. Each roller of the loop rollers 27 is provided with a shaft extending to a direction that is perpendicular to the conveying direction of the sheet P. The loop rollers 27 are rotated in the reverse directions to each other to convey the sheet P along the conveying direction of the sheet P.

The loop rollers 27 correct the skew of the sheet P by conveying the sheet P to hit the forward end of the sheet P to the nip portion 26*a* of the register rollers 26 so that the sheet P becomes curved to form a loop.

The sheet-conveying portion 2 is provided with intermediate conveying rollers 28 that convey to the loop rollers 27 the sheet P which is conveyed from the external feeding tray 20 or the sheet P which is conveyed from any feeding trays 21 inside the image-forming apparatus 1 at the downstream side of the conveying roller 20*b* and the upstream side of the loop rollers 27.

The sheet-conveying portion 2 includes a next sheet conveying sensor 29*a* that detects a next sheet P which the external feeding tray 20 feeds, and an intermediate conveying sensor 29*b*. The next sheet conveying sensor 29*a* is an example of a sheet detection portion (may be referred to as "a sheet detector") and is provided at the downstream side of the conveying roller 20*b* and the upstream side of the intermediate conveying rollers 28. When the forward end of the sheet P put on the external feeding tray 20 is conveyed up to the detection position by the next sheet conveying sensor 29*a*, conveyance of the next sheet P temporarily stops or conveying speed thereof is changed in a case where there is a preceding sheet.

The intermediate conveying sensor 29*b* is also an example of the sheet detection portion and is provided at the downstream side of the intermediate conveying rollers 28 and the upstream side of the loop rollers 27. When the forward end of the sheet P is conveyed up to the detection position by the intermediate conveying sensor 29*b*, conveying speed of the sheet P is changed. When the sheets are successively conveyed, the conveyance of the following sheet P is again started in a case where the rear end of the preceding sheet is conveyed up to the detection position of the intermediate conveying sensor 29*b*.

In one or more embodiments, it is determined whether or not the sheet P is conveyed to a predetermined conveying speed change position which is set according to the length L of the sheet P along the conveying direction thereof by detecting the sheet P conveyed from the external feeding tray 20 by the next sheet conveying sensor 29*a* and the intermediate conveying sensor 29*b*. Here, when a length from the next sheet conveying sensor 29*a* to the rear end P1 of the external feeding tray 20 is set to be L1 and a length from the intermediate conveying sensor 29*b* to the rear end P1 of the external feeding tray 20 is set to be L2, L1 is shorter than L2.

The sheet-conveying portion 2 includes a register sensor 29*c* that detects the sheet P that is conveyed to register rollers 26. The register sensor 29*c* is an example of the sheet detection portion and is positioned at an upstream side of the register rollers 26 along the conveying direction of the sheet P.

After the forward end of the sheet P that is conveyed on the main sheet-conveying route 23 reaches a detection position of the register sensor 29*c*, a conveying amount of the sheet that is required for correcting the skew of the sheet P by hitting the forward end of the sheet P to the nip portion 26*a* of the register rollers 26 is previously set according to a distance between the detection position of the register sensor 29*c* and the nip portion 26*a* of the register rollers 26.

Thus, when the register sensor 29*c* detects the forward end of the sheet P conveying on the main sheet-conveying route 23, the sheet P is conveyed according to the previously set conveying amount thereof, so that the forward end of the sheet P is stricken to the nip portion 26*a* of the register rollers 26 to correct the skew.

The sheet-conveying portion 2 also includes a deviation detection sensor 29*d* that detects the position of the sheet P conveyed by the register rollers 26 along the width direction thereof. The deviation detection sensor 29*d* is positioned at a downstream side of the register rollers 26 along the conveying direction of the sheet P. For example, the deviation detection sensor 29*d* is constituted of a line sensor that extends along the width direction of the sheet P. A register fluctuation operation is performed on the basis of the position of the sheet P along the width direction thereof or the like by detecting an end surface of the sheet P, which has been passed through the register rollers 26, along the width direction thereof by the deviation detection sensor 29*d*.

The sheet-conveying portion 2 further includes a forward end detection sensor 29*e* that detects the forward end of the sheet P conveyed to the transfer nip portion 19. The forward end detection sensor 29*e* is positioned at a downstream side of the deviation detection sensor 29*d* and an upstream side of the transfer nip portion 19. When the forward end detection sensor 29*e* detects the forward end of the sheet P, image writing timing is controlled.

The reverse sheet-conveying route 24 branches from the main sheet-conveying route 23 at a downstream side of the fixing portion 3. The reverse sheet-conveying route 24 includes a change-over gate 23*a* at a branch portion of the main sheet-conveying route 23 and the reverse sheet-conveying route 24. The reverse sheet-conveying route 205 includes a first reverse sheet-conveying route 24*a* which is diverged from the main sheet-conveying route 23 downward and extends almost horizontally below the main sheet-conveying route 23. In the first reverse sheet-conveying route 24*a*, the conveying direction of the sheet P alters from a direction shown by an arrow D1 in FIG. 5 to a direction shown by an arrow D2 in FIG. 5.

The reverse sheet-conveying route 24 also includes a second reverse sheet-conveying route 24*b* diverged upward from the first reverse sheet-conveying route 24*a* in connection with the conveying direction shown by the arrow D2 and curved like U shape, and a third reverse sheet-conveying route 24*c* which extends from the second reverse sheet-conveying route 24*b* along the first reverse sheet-conveying route 24*a*. The reverse sheet-conveying route 24 further includes a fourth reverse sheet-conveying route 24*d* which is curved from the third reverse sheet-conveying route 211 like almost U shape and comes together the main sheet-conveying route 23.

In the image-forming apparatus 1, an image is formed on an upward surface of the sheet P conveyed on the main sheet-conveying route 23 and passed through the transfer nip portion 19 and the fixing portion 3. When the images are formed on both surfaces of the sheet P, the sheet P, in which the image has been formed on one upward surface, is conveyed is from the main sheet-conveying route 23 to the first reverse sheet-conveying route 24*a* of the reverse sheet-conveying route 24, so that the image formed surface of the sheet P faces downward.

When the sheet P conveyed to the first reverse sheet-conveying route 24*a* is conveyed from the second reverse sheet-conveying route 24*b* to the third reverse sheet-conveying route 24*c*, the image formed surface of the sheet P faces upward. Further, when the sheet P conveyed to the third reverse sheet-conveying route 24*c* is conveyed from the fourth reverse sheet-conveying route 24*d* to the main sheet-conveying route 23, the image formed surface of the sheet P again faces downward. This enables the sheet P to be reversed, thereby allowing the image to be formed on the other upward surface of the sheet P.

The fixing portion 3 performs fixing on the sheet, to which the image has been transferred, to fix the image formed on the sheet P. The fixing portion 3 is provided with a pair of fixing rollers 31 and 32 as fixing members, which are contacted to each other with any pressure. The contact of the fixing rollers 31 and 32 to each other with any pressure enables forming a fixing nip portion 33.

Further, the fixing portion 300 is provided with a fixing heater 34 that heats the fixing roller 31 as heating member for heating the fixing member. The fixing heater 34 switches on by turning on electricity. As the fixing heater 34, for example, halogen lamp is used. The fixing portion 3 conveys the sheet P and fixes the image on the sheet P by fixing the image with the pair of the fixing rollers 31 and 32 by applying any force to the sheet P and with the fixing heater 34 by heating the sheet P.

<Control Function Example of Image-Forming Apparatus according to one or more Embodiments of the Invention>

Figure 6:
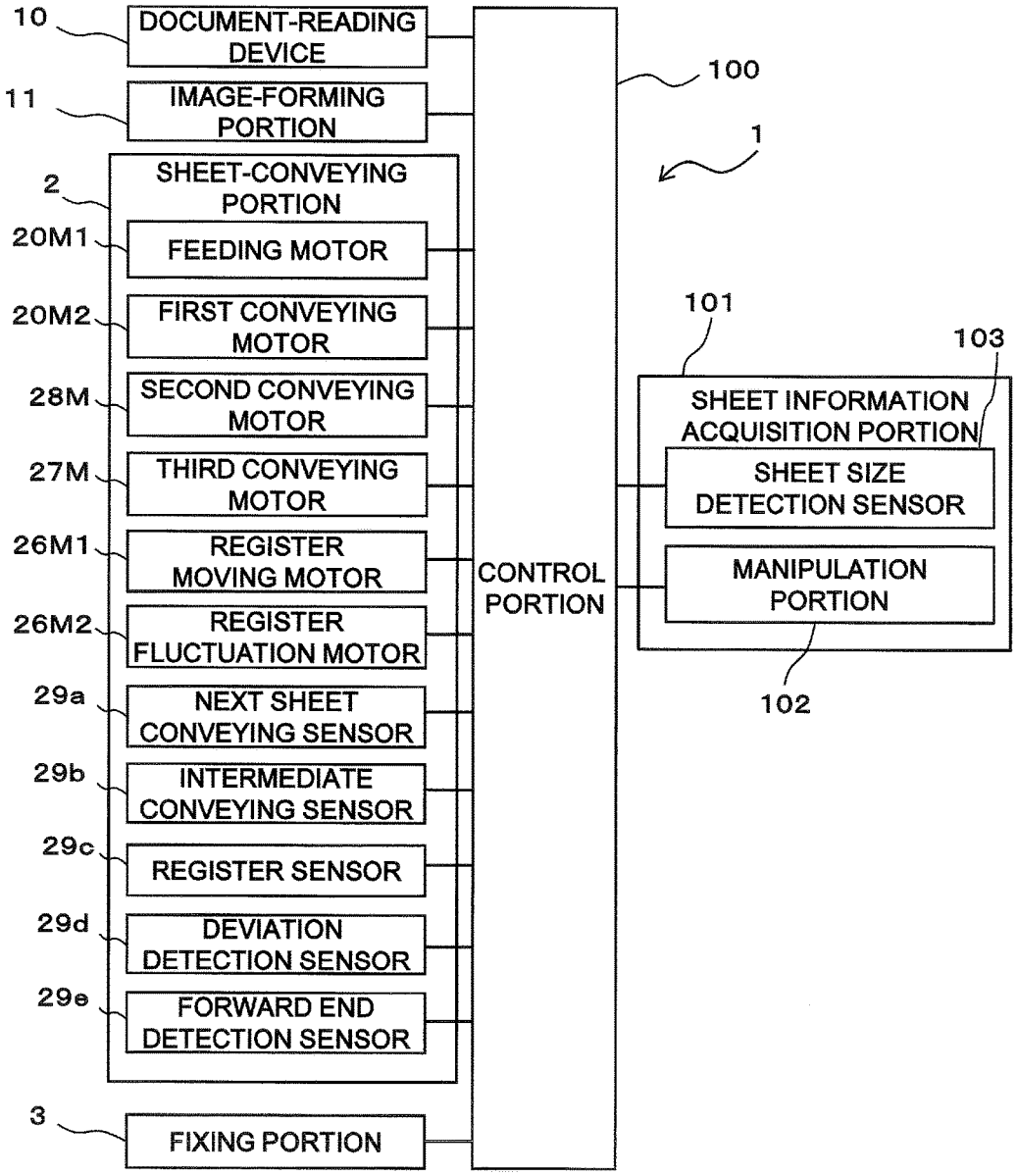
FIG. 6 is a block diagram showing a control function of the image-forming apparatus according to one or more embodiments of the present invention.

FIG. 6 shows a control function example of the image-forming apparatus 1 according to one or more embodiments of the present invention. The following will describe a control function on an operation to convey the long sheet P.

The image-forming apparatus 1 includes a control portion 100 (may be referred to as "a controller") that controls a series of operations in the image-forming apparatus 1 from the feeding of the sheet P to the ejection of the sheet P through the image formation. The control portion 100 is an example of a control portion of this invention and is provided with a micro processer, such as CPU or MPU and a memory such as RAM and ROM as storage member.

An ordinary operation to form an image on the sheet P in the image-forming apparatus 1 will be described. The control portion 100 controls the sheet-conveying portion 2 to convey the sheet P. The control portion 100 also controls the image-forming portion 11 to form the image on the sheet P based on image data acquired from the document by the document-reading device 10 or image data acquired from outside. The control portion 100 further controls the fixing portion 3 to fix the image on the sheet P and to eject the sheet P on which the image is formed.

The image-forming apparatus 1 includes a feeding motor 20M1 that rotates or stops the feeding roller 20*a*. The image-forming apparatus 1 includes a first conveying motor 20M2 that rotates or stops the conveying roller 20*b*. The image-forming apparatus 1 includes a second conveying motor 28M that rotates or stops the intermediate conveying rollers 28. The image-forming apparatus 1 includes a third conveying motor 27M that rotates or stops the loop rollers 27. The image-forming apparatus 1 includes a register moving motor 26M1 that rotates or stops the register rollers 26. The image-forming apparatus 1 includes a register fluctuation motor 26M2 that moves the register rollers 26 to a fluctuation direction.

The control portion 100 acquires a conveying speed of the sheet P and the conveying speed change position at which the conveying speed is changed on the basis of sheet information of the sheet P including a size thereof, paper weight thereof and the like, which has been acquired by a sheet information acquisition portion 101 (may be referred to as "a sheet information acquirer").

The sheet information acquisition portion 101 includes a manipulation portion 102 (may be referred to as "a manipulator") through which a user selects a size of the sheet P and the paper weight thereof, a sheet size detection sensor 103 that detects a size of each of the sheets P set in the feeding trays 21 and the like. Here, the external feeding tray 20 is configured not to acquire any information on the size of the sheet P put thereon or the like. Therefore, the manipulation portion 102 may set the size of the sheet P. The manipulation portion 102 may set the information on the paper weight of the sheet P, a type of the sheet P and stiffness of the sheet P other than the size of the sheet P. The manipulation portion 102 may set the operating environment such as temperature, humidity and the like.

In one or more embodiments, the control portion 100 sets a first feeding speed V0 when the first sheet having a length that is shorter than the length L10 of the external feeding tray 20 is fed and a second feeding speed V2 when the second sheet having a length that is longer than the length L10 of the external feeding tray 20 is fed. The control portion 100 also sets an image-forming and conveying speed V1 as the conveying speed for forming the image on the sheet P fed from the external feeding tray 20. A relationship among these speeds is set to be V0>V1>V2.

The control portion 100 acquires the length L of the sheet P identified by the size information based on the size information and paper weight information of the sheet P selected by the manipulation portion 102 and the size information of the sheet P detected by the sheet size detection sensor 103.

When the sheet P put on the external feeding tray 20 is a sheet of an ordinary size, the length L of which is shorter than the length L10 of the external feeding tray 20 and in which the rear end of the sheet P does not hang down from the rear end of the external feeding tray 20, the sheet P is fed from the external feeding tray 20 at the first feeding speed V0.

On the other hand, when the sheet P put on the external feeding tray 20 is a long sheet, the length L of which is longer than the length L10 of the external feeding tray 20 and in which the rear end of the sheet P hangs down from the rear end of the external feeding tray 20, the sheet P is fed from the external feeding tray 20 at the second feeding speed V2 that is slower than the first feeding speed V0.

Further, a section between the feeding roller 20*a* and the next sheet conveying sensor 29*a* is set to be A1; a section between the next sheet conveying sensor 29*a* and the intermediate conveying sensor 29*b* is set to be A2; a section between the intermediate conveying sensor 29*b* and the register sensor 29*c* is set to be A3; and a section from the register sensor 29*c* is set to be A4.

The control portion 100 sets the conveying speed of the sheet P in each of the sections based on the sheet information such as a size, paper weight and the like of the sheet P acquired by the sheet information acquisition portion 101. The control portion 100 then sets as the conveying speed change position the sheet detection position by the next sheet conveying sensor 29*a,* the intermediate conveying sensor 29*b* or the register sensor 29*c,* or a position in which the sheet P is conveyed at a predetermined amount from the sheet detection position, based on the conveying speed on each of the sections. The control portion 100 changes the conveying speed of the sheet P based on whether or not each sensor detects the sheet P. It is to be noted that as the sheet detection portion, the control portion 100 may calculate a conveyed amount of the sheet P from a rotation amount of the motor that drives each roller, in addition to the sensors for detecting the sheet, to detect a position of the sheet P.

<Operation Example of Image-Forming Apparatus according to one or more Embodiments of the Invention>

Figure 7:
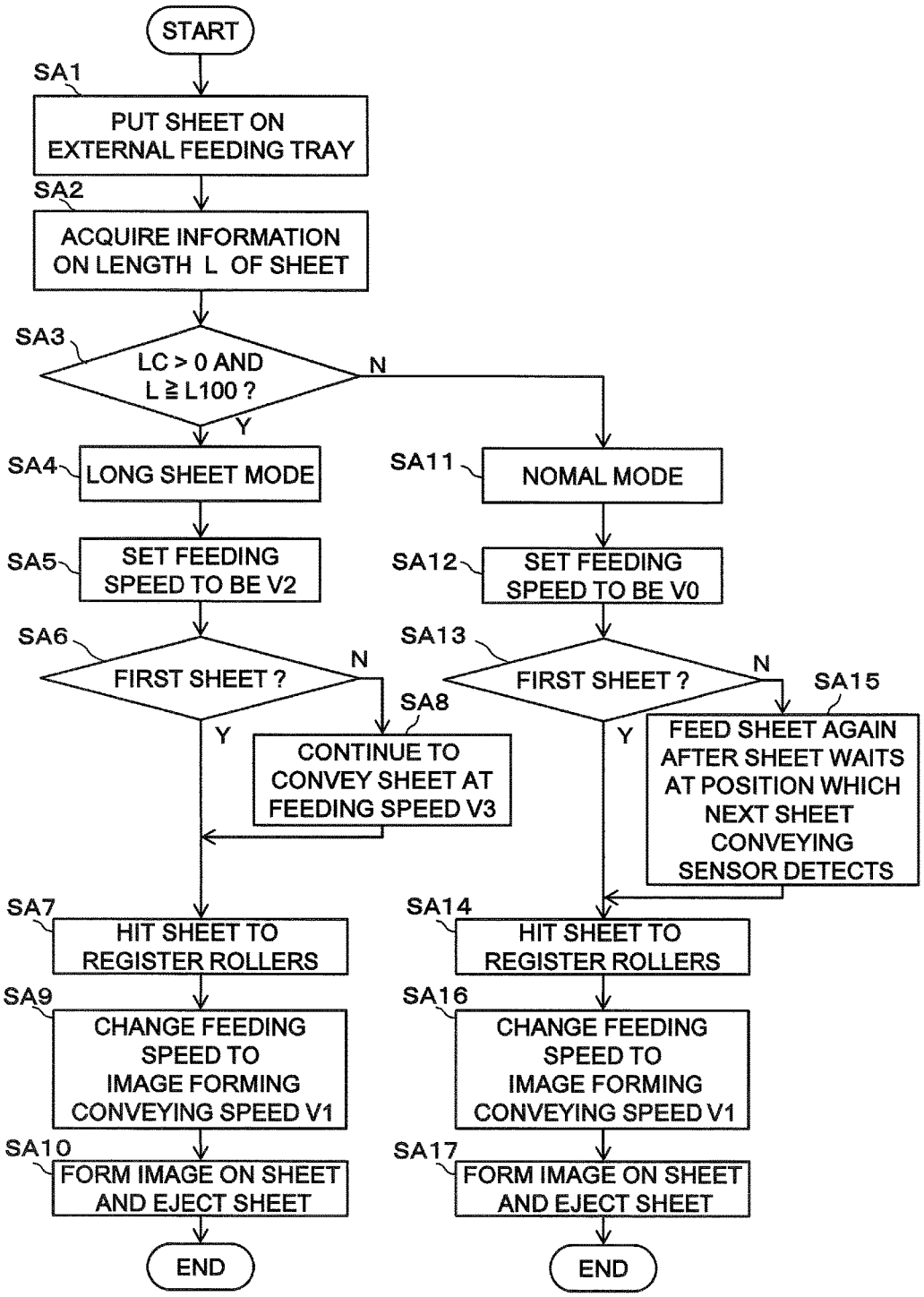
FIG. 7 is a flowchart showing an example of an operation of the image-forming apparatus according to one or more embodiments of the present invention.

FIG. 7 shows an example of the operation of the image-forming apparatus 1 according to one or more embodiments of the present invention. The following will describe an example of the operation of the image-forming apparatus 1 with reference to drawings.

At a step, SA1 of FIG. 7, the control portion 100 determines that the sheet P is put on the external feeding tray 20 and then, at a step, SA2 of FIG. 7, the control portion 100 acquires any information on the length L of the sheet P identified by the size information based on the size information and paper weight information of the sheet P selected by the manipulation portion 102 and the size information of the sheet P detected by the sheet size detection sensor 103.

At a step, SA3 of FIG. 7, when a length of a part of the sheet P which projects from the rear position P1 of the external feeding tray 20 is set to be LC, the control portion 100 determines whether or not the rear end of the sheet P hangs down from the rear position P1 of the external feeding tray 20, namely, LC>0 and the length L of the sheet P is equal to or longer than a predetermined threshold value L100.

In a case where the external feeding tray 20 has a configuration shown in FIG. 4A, the rear end of the sheet P hangs down from the rear position P1 of the external feeding tray 20 because the length L of the sheet P is longer than the length L10 of the external feeding tray 20 along the conveying direction of the sheet P, namely, L10<L. Further, in a case where the external feeding tray 20 has a configuration shown in FIG. 4B, the rear end of the sheet P hangs down from the rear position P1 of the external feeding tray 20 because the length L of the sheet P is longer than the length $L10_1+L10_2$ of the external feeding tray 20 along the conveying direction of the sheet P, namely, $(L10_1+L10_2)<L$. In this embodiment, the threshold value L100 is set to be 483 mm.

If the control portion 100 determines at the step, SA3 of FIG. 7 that LC>0 and the length L of the sheet P is equal to or longer than the predetermined threshold value L100, then at a step, SA4 of FIG. 7, the control portion 100 selects a long sheet mode. In the long sheet mode, the control portion 100 controls the feeding motor 20M1 and the first conveying motor 20M2 to start the conveyance of the sheet P at the second feeding speed V2 that is slower than the first feeding speed V1, at a step, SA5 of FIG. 7.

It may be influenced by a width of the sheet P and/or a stiffness of the sheet P whether or not the rear end of the sheet P hangs down from the rear position P1 of the external feeding tray 20 or the rear end of the sheet P rises. When the width of the sheet P is narrower, the sheet P is subject to a twist. Such a sheet is also subject to unbalance when the sheet rises from the external feeding tray 20 as compared by the wider sheet. Accordingly, the manipulation portion 102 can set the width of the sheet P. In one or more embodiments, when the width of the sheet P set by the manipulation portion 102 is narrower than 150 mm, the control portion 100 selects the long sheet mode.

When the paper weight of the sheet P is smaller, the stiffness thereof deteriorates so that such a sheet is subject to the raise from the external feeding tray 20. Accordingly, the manipulation portion 102 can set the weight or type of the sheet P. In one or more embodiments, when the paper weight of the sheet P set by the manipulation portion 102 is not more than 200*g,* the control portion 100 selects the long sheet mode. Further, the stiffness of the sheet P alters under the use environments. Accordingly, the manipulation portion 102 can set an installation location of the image-forming apparatus 1, the use environments thereof and the like. A detection portion that detects the temperature and the humidity may be provided so that when the detected temperature and/or humidity are/is more than, for example, their predetermined threshold values, the control portion 100 may select the long sheet mode.

At a step, SA6 of FIG. 7, the control portion 100 determines whether or not the sheet P is a first sheet when starting feeding of sheet(s). If the control portion 100 determines that the sheet P is the first sheet, then at a step, SA7 of FIG. 7, the sheet P is conveyed up to a position where the sheet P is hit to the register rollers 26.

If the control portion 100 determines that the sheet P is the second sheet or later at the step, SA6 of FIG. 7, then at a step. SA8 of FIG. 7, the sheet P is conveyed at the conveying speed V3. The conveying speed V3 meets the condition of V3≤V2 and is set so that a predetermined space between the conveying sheets can be kept when the preceding sheet P passes through the intermediate conveying sensor 29*b*.

When the sheet P reaches the position where the sheet P is hit to the register rollers 26 at the step, SA7 of FIG. 7, the control portion 100 changes the conveying speed of the sheet P to the image forming conveying speed V1 at a step, SA9 of FIG. 7. In this condition, at a step, SA10 of FIG. 7, the control portion 100 controls the image-forming portion 11 to form image (s) on the sheet P and to eject the image-formed sheet P, which completes the image-forming process.

If the control portion 100 determines at the step, SA3 of FIG. 7 that the length L of the sheet P is shorter than the predetermined threshold value L100, then at a step, SA11 of FIG. 7, the control portion 100 selects an normal mode. In the normal mode, the control portion 100 controls the feeding motor 20M1 and the first conveying motor 20M2 to start the conveyance of the sheet P at the first feeding speed V0, at a step, SA12 of FIG. 7.

At a step, SA13 of FIG. 7, the control portion 100 whether or not the sheet P is a first sheet when starting feeding of sheet(s). If the control portion 100 determines that the sheet P is the first sheet, then at a step. SA14 of FIG. 7, the sheet P is conveyed up to a position where the sheet P is hit to the register rollers 26.

If the control portion 100 determines that the sheet P is the second sheet or later at the step, SA13 of FIG. 7, then at a step, SA15 of FIG. 7, the conveyance of the sheet P stops when the next sheet conveying sensor 29*a* detects the forward end of the following sheet P. When the rear end of the preceding sheet P passes through the intermediate conveying sensor 29*b*, the conveyance of the following sheet P restarts.

When the sheet P reaches the position where the sheet P is hit to the register rollers 26 at the step, SA14 of FIG. 7, the control portion 100 changes the conveying speed of the sheet P to the image forming conveying speed V1 at a step, SA16 of FIG. 7. In this condition, at a step, SA17 of FIG. 7, the control portion 100 controls the image-forming portion 11 to form image(s) on the sheet P and to eject the image-formed sheet P, which completes the image-forming process.

FIGS. 8 through 14 respectively show a relationship between a length of a sheet and a position of the sheet. The following will describe setting of the conveying speed change position in connection with the length of the sheet P.

The control portion 100 determines whether or not the rear end of the sheet P hangs down from the rear position P1 of the external feeding tray 20, on the basis of the size of the sheet P such as the length L of the sheet P, the paper weight of the sheet P and previously fixed length of the external feeding tray 20, at the above-mentioned processing of the step SA3 of FIG. 7.

When the control portion 100 determined that the rear end of the sheet P does not hang down from the rear position P1 of the external feeding tray 20, the control portion 100 changes the conveying speed of the sheet P according to the setting shown in Table 1.

TABLE 1

| | Section | Speed (m/s) | Section Time (T) |
|---|---|---|---|
| Section A1 | Feeding Roller 20a to Next Sheet Conveying Sensor 29a | V0 | T0 |
| Section A2 | Next Sheet Conveying Sensor 29a to Intermediate Conveying Sensor 29b | V0 | T1 |
| Section A3 | Intermediate Conveying Sensor 29b to Register Sensor 29c | V1 | T2 |
| Section A4 | Register Sensor 29c or later | V1 | T3 |

Figure 8:
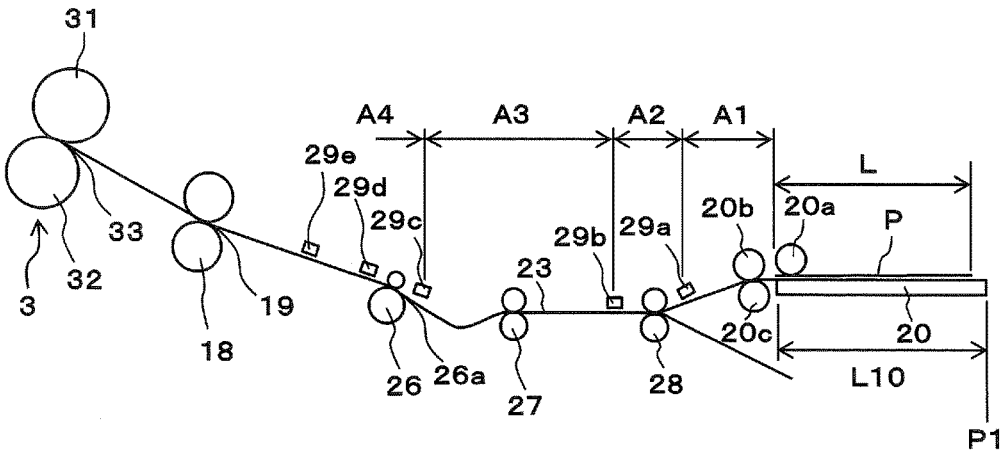
FIG. 8 is a diagram showing a relationship between a length of a sheet and a position of the sheet according to one or more embodiments of the present invention.

When the length L of the sheet P is shorter than the length L10 of the external feeding tray 20, the rear end of the sheet P does not hang down from the rear end position P1 of the external feeding tray 20, as shown in FIG. 8. In this case, the control portion 100 controls the feeding motor 20M1 and the first conveying motor 20M2 to start the conveyance of the sheet P from the external feeding tray 20 at the first feeding speed V0 according to the above-mentioned steps SA11 and SA12 of FIG. 7.

Figure 9:
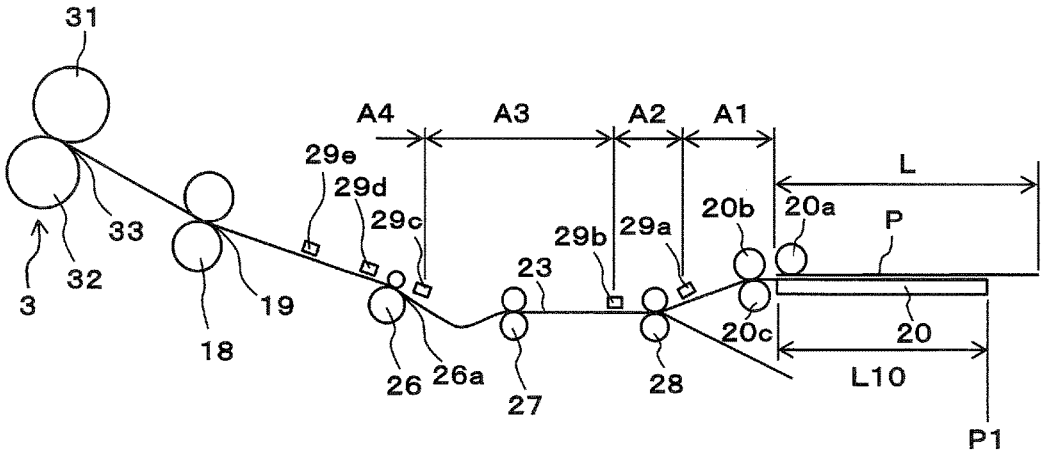
FIG. 9 is a diagram showing a relationship between a length of a sheet and a position of the sheet according to one or more embodiments of the present invention.

Even when the length L of the sheet P is longer than the length L10 of the external feeding tray 20, the rear end of the sheet P does not hang down from the rear end position P1 of the external feeding tray 20, as shown in FIG. 9, in a case where the sheet P has large paper weight to have high stiffness. In this case, the control portion 100 also controls the feeding motor 20M1 and the first conveying motor 20M2 to start the conveyance of the sheet P at the first feeding speed V0.

When the conveyance of the sheet P starts at the first feeding speed V0, the control portion 100 changes the conveying speed of the sheet P from the first conveying speed V0 to the image forming conveying speed V1 after the intermediate conveying sensor 29*b* detects the forward end of the sheet P. The control portion 100 controls the image-forming portion 11 to form the image on the sheet P with the sheet P being conveyed at the image forming conveying speed V1.

When the control portion 100 determines that the rear end of the sheet P put on the external feeding tray 20 hangs down from the rear end position P1 of the external feeding tray 20, the control portion 100 changes the conveying speed of the sheet P based on ant setting shown in Tables 2 through 5 according to the length of the sheet P.

TABLE 2

| | Section | Speed (m/s) | Section Time (T) |
|---|---|---|---|
| Section A1 | Feeding Roller 20a to Next Sheet Conveying Sensor 29a | V2 | T4 |
| Section A2 | Next Sheet Conveying Sensor 29a to Intermediate Conveying Sensor 29b | V0 | T1 |
| Section A3 | Intermediate Conveying Sensor 29b to Register Sensor 29c | V1 | T2 |
| Section A4 | Register Sensor 29c or later | V1 | T3 |

TABLE 3

| | Section | Speed (m/s) | Section Time (T) |
|---|---|---|---|
| Section A1 | Feeding Roller 20a to Next Sheet Conveying Sensor 29a | V2 | T4 |
| Section A2 | Next Sheet Conveying Sensor 29a to Intermediate Conveying Sensor 29b | V2 | T6 |
| Section A3 | Intermediate Conveying Sensor 29b to Register Sensor 29c | V1 | T2 |
| Section A4 | Register Sensor 29c or later | V1 | T3 |

TABLE 4

| | Section | Speed (m/s) | Section Time (T) |
|---|---|---|---|
| Section A1 | Feeding Roller 20a to Next Sheet Conveying Sensor 29a | V2 | T4 |
| Section A2 | Next Sheet Conveying Sensor 29a to Intermediate Conveying Sensor 29b | V2 | T6 |
| Section A3 | Intermediate Conveying Sensor 29b to Register Sensor 29c | V2 | T7 |
| Section A4 | Register Sensor 29c or later | V1 | T3 |

TABLE 5

| | Section | Speed (m/s) | Section Time (T) |
|---|---|---|---|
| Section A1 | Feeding Roller 20a to Next Sheet Conveying Sensor 29a | V2 | T4 |
| Section A2 | Next Sheet Conveying Sensor 29a to Intermediate Conveying Sensor 29b | V2 | T6 |
| Section A3 | Intermediate Conveying Sensor 29b to Register Sensor 29c | V2 | T7 |
| Section A4 | Register Sensor 29c or later | V2 | T8 |

Figure 10:
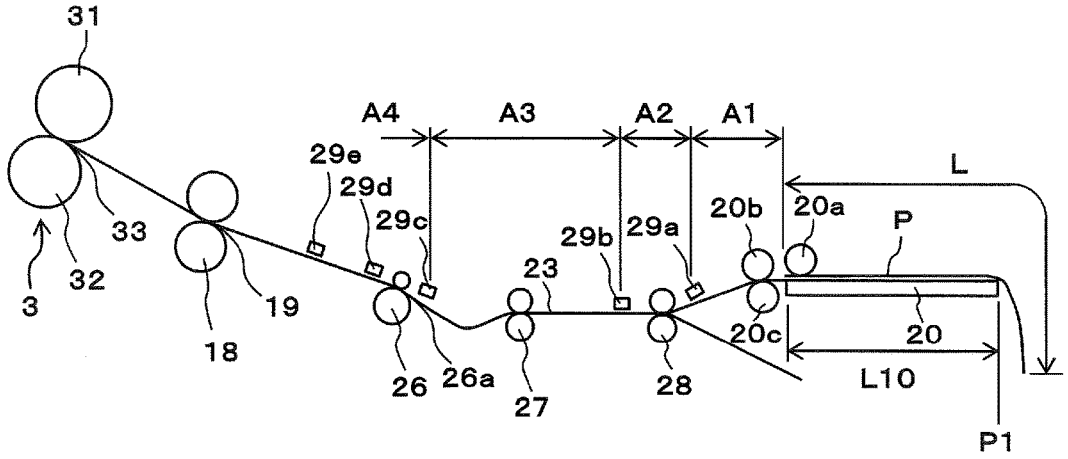
FIG. 10 is a diagram showing a relationship between a length of a sheet and a position of the sheet according to one or more embodiments of the present invention.

When the length L of the sheet P is longer than the length L10 of the external feeding tray 20 and the sheet P has small paper weight to have low stiffness, a part of the sheet P projecting from the rear end position P1 of the external feeding tray 20 hangs down, as shown in FIG. 10. In this case, when the conveyance of the sheet P starts at the first feeding speed V0, the rear end of the sheet P rises. This may cause any deflection of the sheet P.

Accordingly, the control portion 100 controls the feeding motor 20M1 and the first conveying motor 20M2 to start the conveyance of the sheet P at the second feeding speed V2 that is slower than the first feeding speed V0 according to the above-mentioned steps SA4 and SA5 of FIG. 7. This prevents the rear end of the sheet P from rising. Therefore, any deflection of the sheet P can be suppressed and it is possible to suppress any deterioration of printing quality based on the deflection of the sheet P.

When the conveyance of the sheet P starts at the second feeding speed V2, the control portion 100 changes the conveying speed of the sheet P to the image forming conveying speed V1 based on the length L of the sheet P and a position of the rear end of the sheet P. In one or more embodiments, it is possible to know the position of the rear end of the sheet P based on the length L of the sheet P and whether or not the next sheet conveying sensor 29*a*, the intermediate conveying sensor 29*b* or the register sensor 29*c* detects the forward end of the sheet P.

Figure 11:
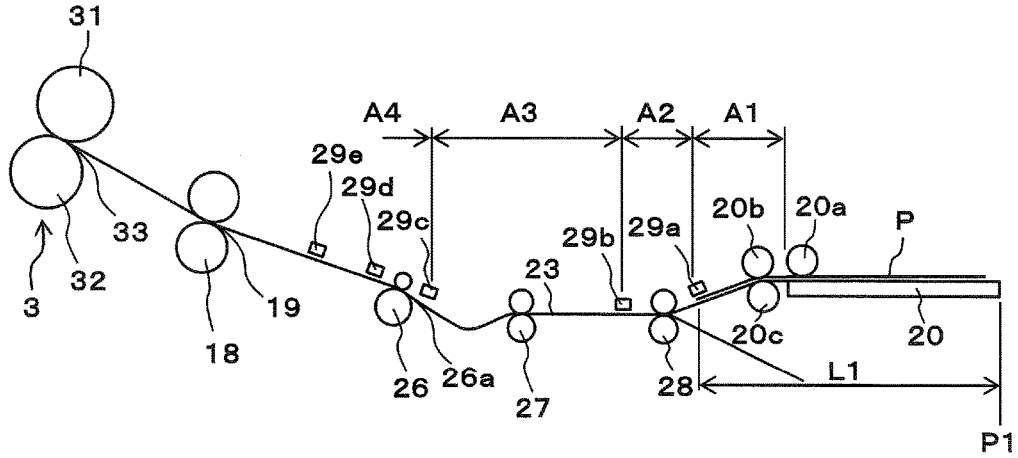
FIG. 11 is a diagram showing a relationship between a length of a sheet and a position of the sheet according to one or more embodiments of the present invention.

For example, when the length L of the sheet P is longer than the length L10 of the external feeding tray 20 and is shorter than a distance L1 from the rear end position P1 of the external feeding tray 20 to the next sheet conveying sensor 29*a*, the rear end of the sheet P does not hang down from the rear end position P1 of the external feeding tray 20, as shown in FIG. 11, in a case where the forward end of the sheet P reaches the detection position by the next sheet conveying sensor 29*a*.

In this case, since the conveying speed can be increased when restarting the conveyance of the following sheet P in the successive feeding after the sheet P temporarily stops at the detection position by the next sheet conveying sensor 29*a*, the control portion 100 changes the conveying speed of the sheet P to the setting shown in the Table 2. Namely, the control portion 100 changes the conveying speed of the sheet P from the second feeding speed V2 to the first feeding speed V1 to increase the conveying speed of the sheet P when the next sheet conveying sensor 29*a* detects the forward end of the sheet P.

Here, the conveying speed of the sheet P may be gradually increased after the conveyance of the sheet P starts at the second feeding speed V2. For example, from the section A1 to the section A2, the conveying speed of the sheet P may be gradually increased from the second feeding speed V2 to the first feeding speed V0.

It takes a longer conveying time, as compared with a case where the sheet P is conveyed in the section A1 at the first conveying speed V0, when the sheet P is conveyed in the section A1 at the second conveying speed V2 after the conveyance of the sheet P starts at the second feeding speed V2. For example, by comparing the setting of the Table 1 with the setting of the Table 2, T4 is longer than T0 (T4>T0) where T0 is time taken in a case where the sheet P is conveyed at the first conveying speed V0 and T4 is time taken in a case where the sheet P is conveyed at the second conveying speed V2.

Since the sheet P is conveyed at the first conveying speed V0 in the section A2 of both settings, it takes time by difference between T4 and T0 (T4−T0) in the sections A1 and A2. Accordingly, based on the setting of the Table 1 which is used in the normal mode, the conveying speed of the sheet P in the section A2 is set in the setting of the Table 2 so that it is faster than the first conveying speed V0, whereby the time taken in the sections A1 and A2 is set to be T0+T1=T4+T5.

Figure 12:
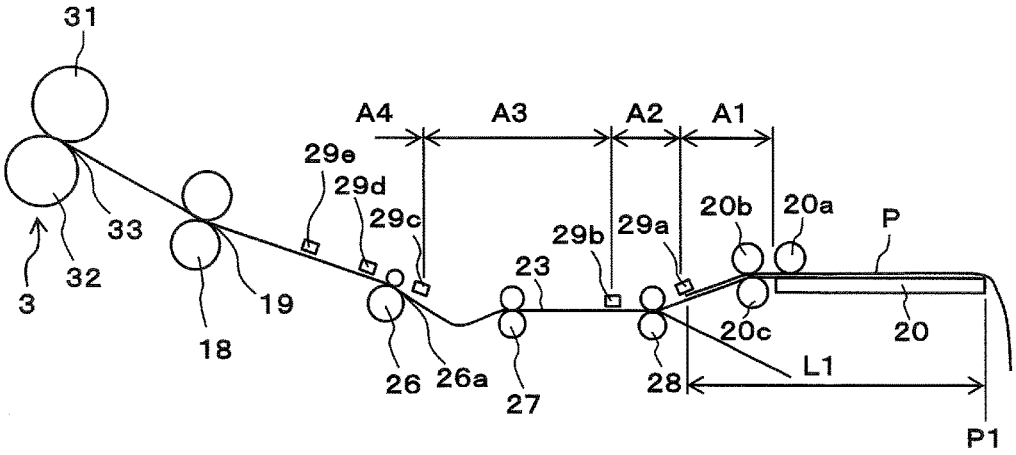
FIG. 12 is a diagram showing a relationship between a length of a sheet and a position of the sheet according to one or more embodiments of the present invention.

When the length L of the sheet P is longer than the distance L1 from the rear end position P1 of the external feeding tray 20 to the next sheet conveying sensor 29*a*, the rear end of the sheet P hangs down from the rear end position P1 of the external feeding tray 20, as shown in FIG. 12, in a case where the forward end of the sheet P reaches the detection position by the next sheet conveying sensor 29*a*. In this case, when the conveying speed of the sheet P is increased while the forward end of the sheet P reaches the detection position by the next sheet conveying sensor 29*a*, the rear end of the sheet P may raise.

Figure 13:
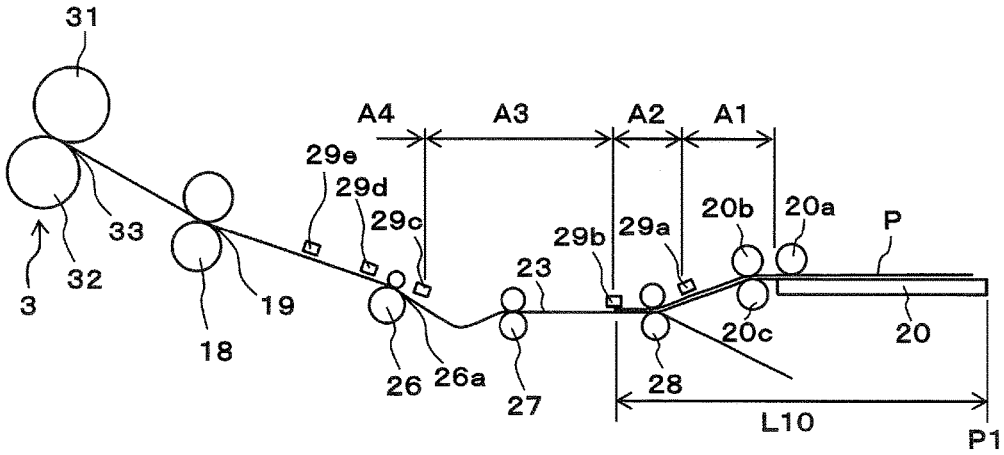
FIG. 13 is a diagram showing a relationship between a length of a sheet and a position of the sheet according to one or more embodiments of the present invention.

When the length L of the sheet P is longer than the distance L1 from the rear end position P1 of the external feeding tray 20 to the next sheet conveying sensor 29*a* and is shorter than a distance L2 from the rear end position P1 of the external feeding tray 20 to the intermediate conveying sensor 29*b*, the rear end of the sheet P does not hang down from the rear end position P1 of the external feeding tray 20, as shown in FIG. 13, in a case where the forward end of the sheet P reaches the detection position by the next sheet conveying sensor 29*a*.

In this case, since the conveying speed can be increased to the image forming conveying speed V1 when the forward end of the sheet P reaches the detection position by the intermediate conveying sensor 29*b*, the control portion 100 changes the conveying speed of the sheet P to the setting shown in the Table 3. Namely, the control portion 100 changes the conveying speed of the sheet P from the second feeding speed V2 to the image forming conveying speed V1 to increase the conveying speed of the sheet P when the intermediate conveying sensor 29*b* detects the forward end of the sheet P.

Figure 14:
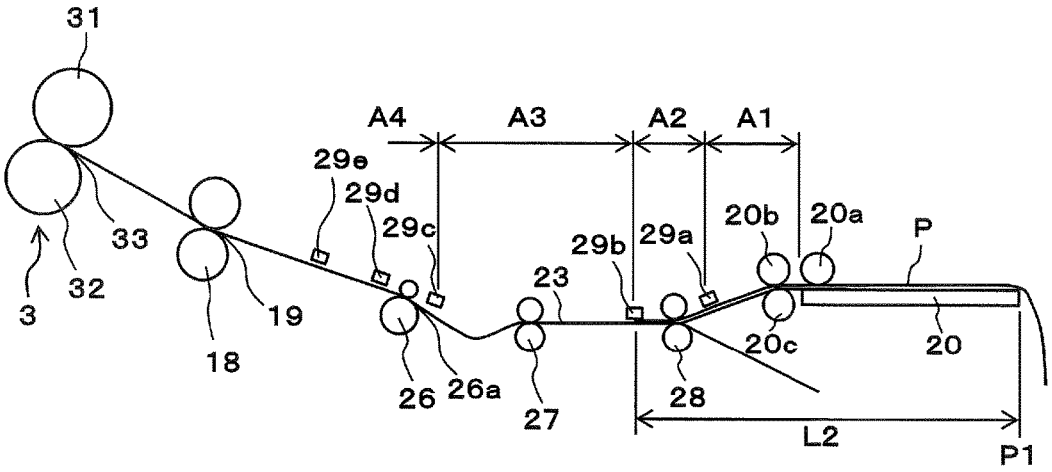
FIG. 14 is a diagram showing a relationship between a length of a sheet and a position of the sheet according to one or more embodiments of the present invention.

When the length L of the sheet P is longer than the distance L2 from the rear end position P1 of the external feeding tray 20 to the intermediate conveying sensor 29*b*, the rear end of the sheet P hangs down from the rear end position P1 of the external feeding tray 20, as shown in FIG. 14, in a case where the forward end of the sheet P reaches the detection position by the intermediate conveying sensor 29*b*. In this case, when the conveying speed of the sheet P is increased while the forward end of the sheet P reaches the detection position by the intermediate conveying sensor 29*b*, the rear end of the sheet P may raise.

Figure 15:
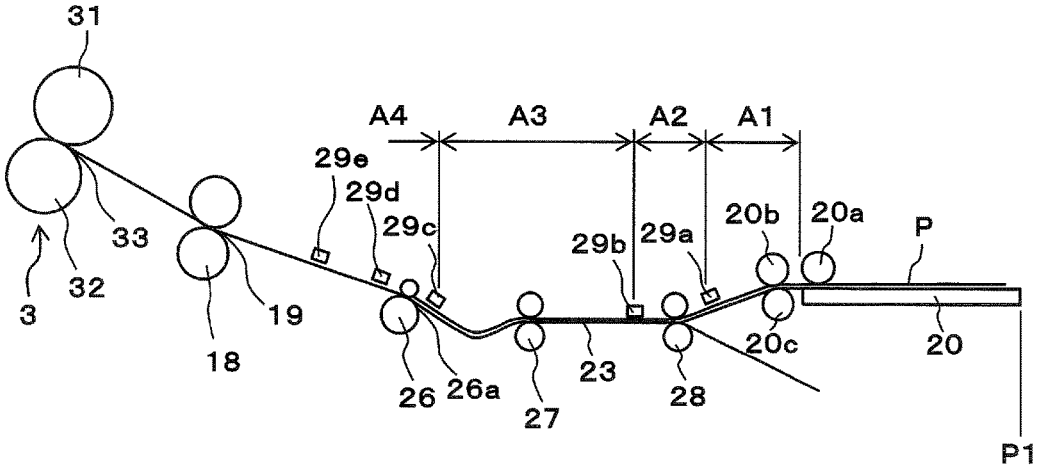
FIG. 15 is a diagram showing a relationship between a length of a sheet and a position of the sheet according to one or more embodiments of the present invention.

When the length L of the sheet P is longer than the distance L2 from the rear end position P1 of the external feeding tray 20 to the intermediate conveying sensor 29*b* and is shorter than a distance from the rear end position P1 of the external feeding tray 20 to the register sensor 29*c*, the rear end of the sheet P does not hang down from the rear end position P1 of the external feeding tray 20, as shown in FIG. 15, in a case where the forward end of the sheet P reaches the detection position by the register sensor 29*c*.

In this case, since the conveying speed can be increased to the image forming conveying speed V1 when the forward end of the sheet P reaches the detection position by the register sensor 29*c* and the conveyance of the sheet P again starts after the register fluctuation operation, the control portion 100 changes the conveying speed of the sheet P to the setting shown in the Table 4. Namely, the control portion 100 changes the conveying speed of the sheet P from the second feeding speed V2 to the image forming conveying speed V1 to increase the conveying speed of the sheet P when the register sensor 29*c* detects the forward end of the sheet P and the conveyance of the sheet P again starts after the register fluctuation operation.

Figure 16:
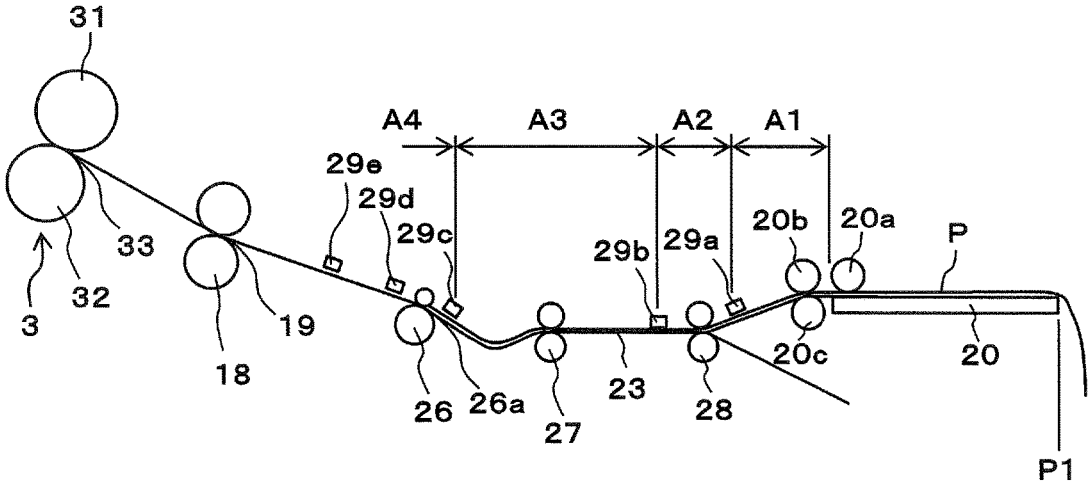
FIG. 16 is a diagram showing a relationship between a length of a sheet and a position of the sheet according to one or more embodiments of the present invention.

When the length L of the sheet P is longer than the distance from the rear end position P1 of the external feeding tray 20 to the register sensor 29*c*, the rear end of the sheet P does hangs down from the rear end position P1 of the external feeding tray 20, as shown in FIG. 16, in a case where the forward end of the sheet P reaches the detection position by the register sensor 29*c* and the conveyance of the sheet P again starts after the register fluctuation operation.

In this case, when the conveying speed of the sheet P is increased while the conveyance of the sheet P again starts after the register fluctuation operation, the rear end of the sheet P may raise. Accordingly, the conveying speed of the sheet P is changed on the basis of the setting of the Table 5. Namely, the control portion 100 maintains the conveying speed of the sheet P at the second conveying speed V2 when the register sensor 29*c* detects the forward end of the sheet P and the conveyance of the sheet P again starts after the register fluctuation operation. When the conveying speed of the sheet P alters after the forward end of the sheet P reaches the transfer nip portion 19, this causes any transfer deviation and/or image deviation. Accordingly, in one or more embodiments, until when the register sensor 29*c* detects the forward end of the sheet P and the conveyance of the sheet P again starts after the register fluctuation operation, the conveying speed of the sheet P is changed according to the length of the sheet P and the like and thereafter, the conveying speed of the sheet P is fixed.

One or more embodiments of the present invention are applicable to an image-forming apparatus which forms an image on a long sheet.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image-forming apparatus, comprising:

an external feeding tray on which a first sheet or a second sheet is placed and that has a length along a conveying direction of the first sheet or the second sheet wherein the first sheet has a shorter length along a conveying direction thereof than the length of the external feeding tray, and the second sheet has a longer length along a conveying direction thereof than the length of the external feeding tray;

an image former;

a sheet feeder that feeds the first sheet or the second sheet from the external feeding tray into the image former, wherein the image former forms an image on the first sheet or the second sheet fed by the sheet feeder;

a sheet information acquirer that acquires sheet information comprising a sheet size that specifies the length of the first sheet or the second sheet; and a controller that:

sets a first conveying speed and a second conveying speed, the second conveying speed being slower than the first conveying speed;

controls the sheet feeder to convey the first sheet at the first conveying speed; and controls the sheet feeder to convey the second sheet at the second conveying speed when the controller determines, based on the sheet information, that a rear end of the second sheet projects from the external feeding tray and hangs down from the external feeding tray.

2. The image-forming apparatus according to claim 1, wherein the controller:

sets a third conveying speed that is faster than the second conveying speed; and controls the sheet feeder to change the conveying speed of the second sheet from the second conveying speed to the third conveying speed when the controller determines that the rear end of the second sheet fed from the external feeding tray at the second conveying speed passes through a rear end position of the external feeding tray and the second sheet reaches a conveying speed change position based on the sheet information.

3. The image-forming apparatus according to claim 1, wherein the controller:

sets an image forming conveying speed to form the image on the second sheet by the image former; and controls the sheet feeder to change the conveying speed of the second sheet from the second conveying speed to the first conveying speed or the image forming conveying speed when the controller determines that the rear end of the second sheet fed from the external feeding tray at the second conveying speed passes through a rear end position of the external feeding tray and the second sheet reaches the conveying speed change position according to a reached position of a forward end of the second sheet, wherein the reached position differs from the length of the second sheet.

4. The image-forming apparatus according to claim 2, wherein the controller controls the sheet feeder to convey the second sheet at the second conveying speed when the controller determines that the rear end of the second sheet fed from the external feeding tray at the second conveying speed does not pass through the rear end position of the external feeding tray and a forward end of the second sheet reaches the conveying speed change position based on the sheet information.

5. The image-forming apparatus according to claim 2, wherein the controller:

determines whether or not the conveying speed of the second sheet fed from the external feeding tray at the second conveying speed is changed; and resets the conveying speed of the second sheet when a forward end of the second sheet reaches a temporal stop position.

6. The image-forming apparatus according to claim 2, further comprising a sheet detector that detects the first sheet or the second sheet, wherein the controller determines a rear end position of the first sheet or the second sheet based on the sheet information when the sheet detector detects a forward end of the first sheet or the second sheet.

7. The image-forming apparatus according to claim 2, wherein the controller accelerates the conveying speed of the second sheet until the second sheet reaches the conveying speed change position when the feeding of the second sheet put on the external feeding tray is started at the second conveying speed.

8. The image-forming apparatus according to claim 2, wherein the third conveying speed is faster than the first conveying speed.

9. The image-forming apparatus according to claim 1, wherein the sheet information acquirer further comprises a manipulator that selects at least one of the sheet size, paper weight of the first sheet or the second sheet, a type of the first sheet or the second sheet, and a use environment of the image-forming apparatus.

10. The image-forming apparatus according to claim 1, wherein the external feeding tray comprises a bent surface on which the first sheet or the second sheet is placed.

* * * * *